United States Patent [19]

Davis

[11] 4,226,002

[45] Oct. 7, 1980

[54] WINDOW OR THE LIKE STAYS

[75] Inventor: Ronald P. Davis, Wellington, New Zealand

[73] Assignee: Interlock Industries Limited, Wellington, New Zealand

[21] Appl. No.: 948,022

[22] Filed: Oct. 2, 1978

[30] Foreign Application Priority Data

Sep. 30, 1977 [NZ] New Zealand ..... 185308
Nov. 23, 1977 [NZ] New Zealand ..... 185769

[51] Int. Cl.[2] ..... E05F 3/22
[52] U.S. Cl. ..... 16/179; 49/248
[58] Field of Search ..... 16/8 V, 193, 49, 54, 16/68, 178, 191, 179; 49/250, 251, 252, 248; 160/75

[56] References Cited

U.S. PATENT DOCUMENTS

| | | | |
|---|---|---|---|
| 1,614,166 | 1/1927 | Whitney | 49/251 X |
| 2,763,037 | 9/1956 | Benton et al. | 49/250 X |
| 3,407,434 | 10/1968 | Scott | 16/193 |
| 3,497,909 | 3/1970 | Davis | 16/193 |
| 3,789,903 | 2/1974 | Clark et al. | 160/75 |
| 4,102,012 | 7/1978 | Davis | 49/248 |

FOREIGN PATENT DOCUMENTS

| | | | |
|---|---|---|---|
| 223598 | 9/1958 | Australia | 49/251 |
| 986665 | 4/1976 | Canada | 49/251 |

*Primary Examiner*—George H. Krizmanich
*Attorney, Agent, or Firm*—Young & Thompson

[57] ABSTRACT

A window stay for adjustable mounting of a window sash into a window frame which comprises a first mounting plate adapted for attachment to the frame of a window and a second mounting plate adapted for attachment to the sash of a window. A carriage is slidably mounted on the first mounting plate. An arm is pivotally connected by one end to the sash mounting plate and by the other end to the frame mounting plate. The sash mounting plate is further pivoted but at a point remote from the pivot coupling the arm to the frame mounting plate to the slidably mounted carriage. Means are provided which cause the carriage to be angularly displaced relative to the frame mounting plate during the initial opening and closing.

18 Claims, 17 Drawing Figures

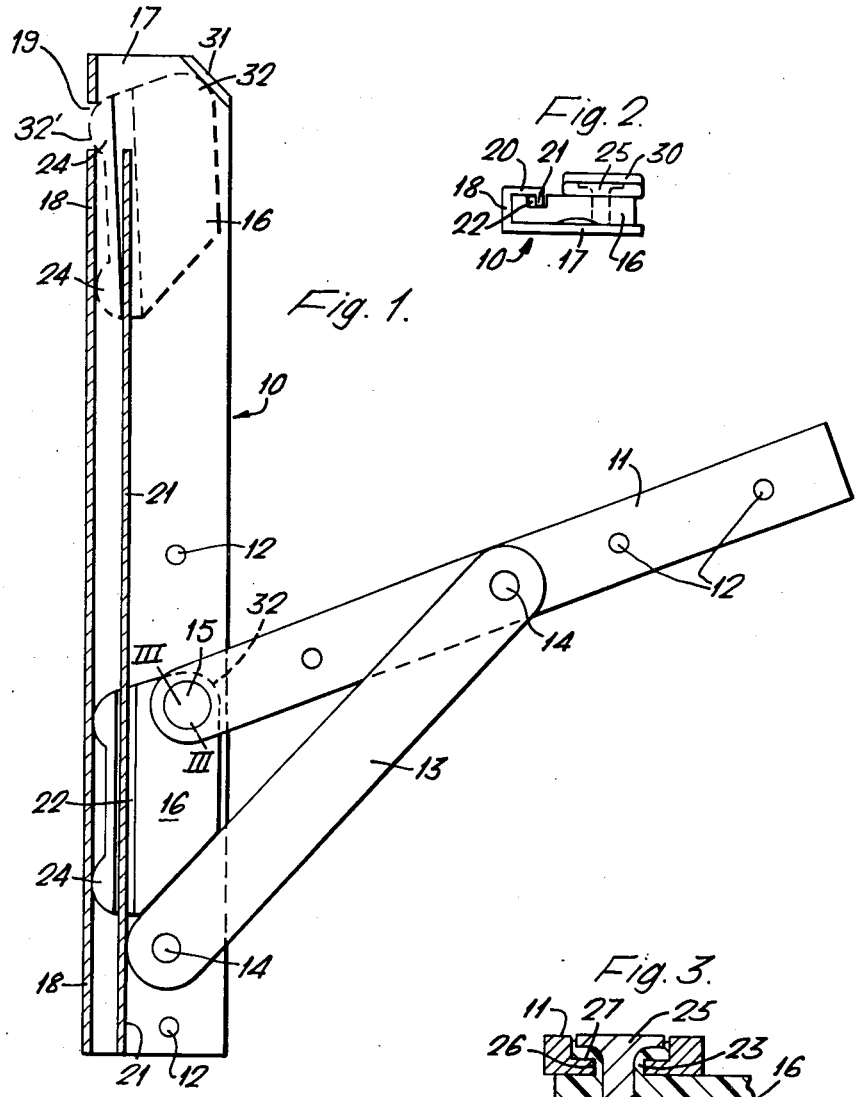
Fig. 1.
Fig. 2.
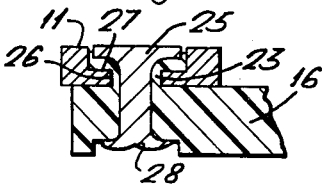
Fig. 3.

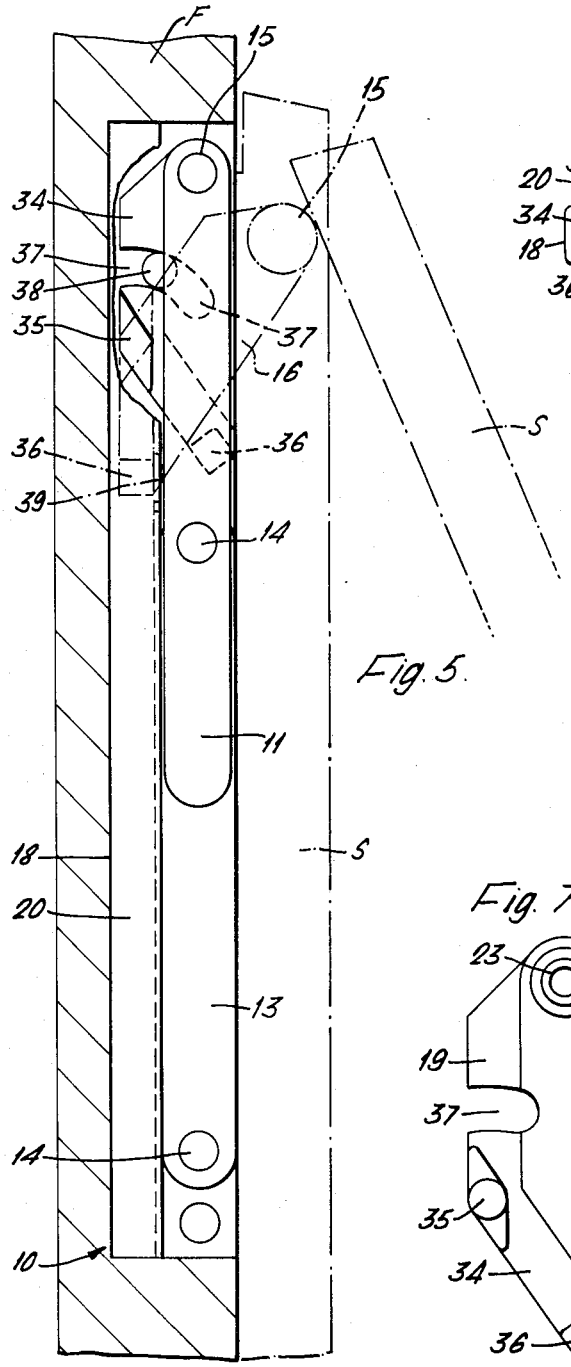
Fig. 5.
Fig. 6.
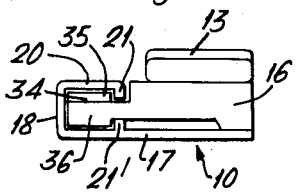
Fig. 7.
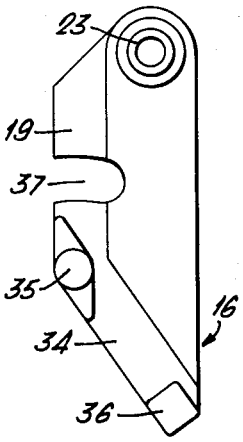
Fig. 8.
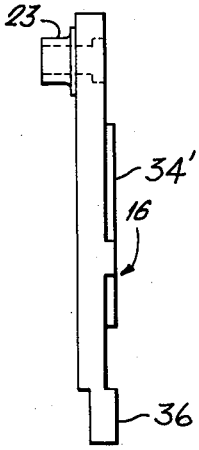

5
11
74
73
74
64
13
72
16
67
61
60
63

21
20
16
11
23
40
43
11
38
10
21'
17
42
41

21
52
53
20
21
51
21'
54
21'

32'
24
23

22
16
83
81
81
24
85
80

83
16
22
81
86
85
80
24
82
24'
24'

WINDOW OR THE LIKE STAYS

This invention relates to a window stay for adjustable mounting of a window sash into a window frame.

It is common practice when hanging a window sash in a frame to use a pair of stays whereby the sash can pivot open or closed about a substantially horizontal axis or, in a casement window, about a substantially vertical axis. A common form of window construction is to have an "overlap" type of sash where the outer edge or peripheral flange of the sash extends beyond the inner perimeter of the window frame. With this type of sash it is necessary to have stays which are of such a construction that during initial opening of the window the sash moves outwardly so that it clears the frame and remains clear during the entire opening action. Traditionally, four arm (per sash) stays are employed and a stay of this form is for example disclosed in our U.K. Pat. No. 1163798. This type of stay is most suitable for use with overlap type windows, however, it is seldom satisfactory for side hung windows i.e. casement windows as the weight of the sash is outside of the line of the window frame and cannot effectively be carried on the extended stay arm.

There are also known two arm (per sash) stays where the ends of the hinge edge of the sash are connected to simple slides. This type of fitting can be used for casement windows as the sash weight is carried directly onto the window sill via the slide. This type of stay is employed where the windows incorporate reversed head sections and transoms and mullions are sometimes eliminated in favour of incorporating the sections in the head or style of the sash. These two arm stays cannot be used for "overlap" type sashes as the extending sash frame would foul with the front face of the window frame as it is opened. Known types of two arm stays do not have provision for pulling in of the head of the sash so that it is tight against the frame. This so called "pull-in" during the final closing stages ensures the sash positively engages with the window frame or seals contained therein. A sash carried by these known stays must have sufficient clearance of the sealing faces or seals of the window frame during the final closing stages. This means that positive sealing cannot take place though this would of course be overcome if the stay provided a degree of pull-in such that the sash firstly clears the sealing surfaces or seals and then in the final closing movement moves inwardly toward the frame i.e. pulls in to possitively engage with the seals or sealing surfaces of the frame.

These two arm stays have usually incorporated a sliding friction carriage which moves along a frame mounting plate. The carriage is, not free sliding so that the degree of opening of the stay and hence window can be adjusted. Unfortunately, the degree of friction preventing free sliding of the carriage varies according to the angle of opening and is often more than that required for control of the stay. The amount of force therefore required to open and close the stay can vary depending on the position from or to which the carriage is moved. In addition wear takes place in time which can either reduce or increase the amount of friction and so make the stay difficult to operate or indeed ineffective.

Broadly, in one aspect the invention provides a window stay for adjustable mounting of a window sash into a window frame comprising a first mounting plate adapted for attachment to the frame of a window, a second mounting plate adapted for attachment to a sash of a window, a carriage slidably mounted on the first mounting plate, an arm which is pivoted at one end to the second mounting plate and at its other end to the first mounting plate, the second mounting plate being further pivoted, at a point remote from the pivot coupling the arm, to the carriage, and means which cause said carriage to be angularly displaced relative to said frame mounting plate during the initial opening and closing operation.

Preferably the carriage is free sliding and at least one of the pivots is a wear resistant friction joint.

The invention as claimed is intended to combine the load carrying capacity of the two arm stays but because of its construction provides pull-in at the final stages of closing so that the sash clears the sealing surfaces or seals at the frame before final engagement therewith or when mounting an overlap sash ensures that the sash flange does not foul with the frame.

In more fully describing the invention in its preferred forms reference will be made to the accompanying drawings in which:

FIG. 1 is an elevation view of a first form of the stay in an open position with return 20 omitted in the interests of clarity, FIG. 2 is a top end view, FIG. 3 is an enlarged cross sectional view through the pivot connection of the sash mounting plate to the sliding carriage taken on the line III—III of FIG. 1, FIG. 4 is an elevation view of a second form of the stay in an open position, FIG. 5 is a similar view to that of FIG. 4 but with the stay in the closed position, FIG. 6 is an end view of the stay shown in FIG. 5, FIG. 7 is a plan view of the carriage of the stay of FIGS. 4 to 6, FIG. 8 is a side elevation of the carriage of FIG. 7, FIG. 9 is a side elevation of a third form of the stay in an open position, FIG. 10 is a view similar to FIG. 9 but with the sash mounting plate open at 90° to the frame mounting plate, FIG. 11 is a further view of the stay in FIG. 9 but with the sash mounting plate in the fully open or reversed position, FIG. 12 is an edge on elevational view of the stay of FIG. 9 in the closed position, FIG. 13 is a sectional view taken along a line generally indicated by I—I in FIG. 4 but with the sash mounting plate in position and coupled to the carriage by an adjustable pivot joint.

Figure 4:
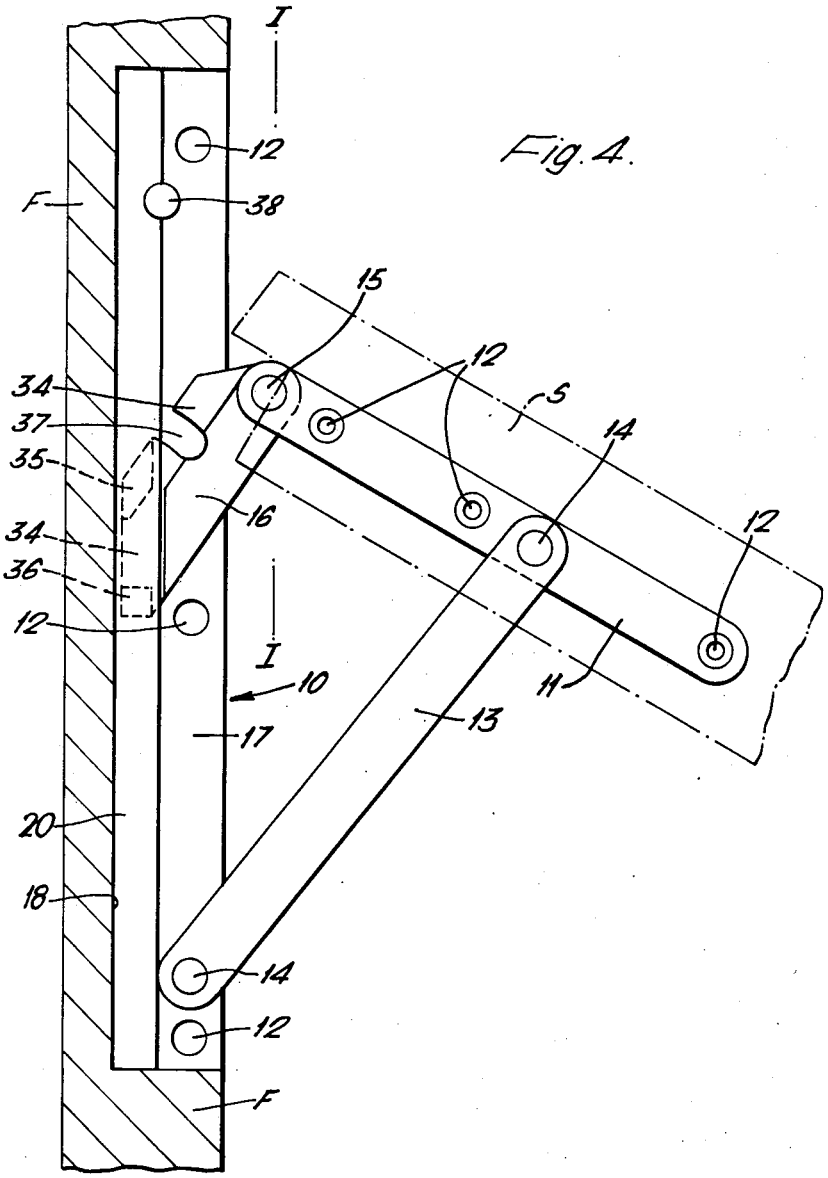

Throughout the following description reference will be made to a single stay in relation to a window sash and mounting frame but it will be appreciated that to mount any sash a pair of such stays are normally employed. The stays can be mounted by their frame mounting plates to either the side members of the frame or with casement window to the top and bottom members. Where appropriate, features common to the different forms of the invention will have the same reference numerals.

The first or frame mounting plate is shown at 10 and the second or sash mounting plate at 11. Countersunk openings 12 are provided along the length of the each plate 10 and 11 for the reception of fastening rivets, screws etc by which said plate can be fastened to the respective frame and sash. Arm 13 is joined by one end thereof at or adjacent one end of plate 10 whilst the other end is coupled to the second plate 11. Assuming the stays shown in the drawings are in the vertical position arm 13 is attached at or adjacent the lower end of plate 10 and approximately medially in plate 11.

One or both of the pivot joints 14 by which arm 13 is coupled to plates 10 and 11 is a wear-resistant friction joint preferably of the type described in either of U.K. Pat. Nos. 1163798 and 1304830.

Preferably, the pivot joints 14 are of the type disclosed in patent specification No. 1304830. In this form the shank of a rivet, which is of circular cross-section, engages through a non-circular opening, in plate 10 or 11. The head of the rivet is preferably located in a recess in arm 13 whilst the tail of the rivet is pressed onto the surface of plate 10 or 11 surrounding the non-circular opening. The pressed tail of the rivet is also preferably located in a recess. Due to the tail being pressed onto plates 10 and 11 plus the non-circular opening the rivet cannot rotate. To ensure there is no metal to metal contact between arm 13 and both the rivet and mounting plates a wear resistant self-lubricating plastics material such as Nylon is provided therebetween.

Accordingly, arm 13 can pivot about the rivet but only engages the wear-resistant material.

The upper end of plate 11 is coupled by a pivot joint 15 to a sliding carriage 16. It will be appreciated that in FIG. 1 the stay is shown in its fully open position though the carriage is also shown in its upper position which corresponds to the closed position of the stay. The reasons for the carriage being shown in the upper position will become apparent from the following disclosure.

Frame plate 10 has a main length 17 with a flange 18 extending along one side thereof. This flange 18 has a return 20 which is parallel to portion 17 and this in turn has a downwardly depending lip 21. The flange 18, return 20 and lip 21 form a guide means for carriage 16.

Carriage 16 is preferably formed from nylon or other suitable plastics material and thus readily slides along the length of plate 10. Alternatively, carriage 16 can be of metal construction with the surfaces in contact with plate 10 formed by inserts or pads of plastics material (such as nylon). The carriage 16 and plate 10 are thus so formed that the carriage moves with minimum friction such that it can be termed free sliding. Referring to FIG. 3 a more detailed illustration of pivot 15 is shown. This pivot is also of a wear-resistance friction type as described above. Carriage 16 is formed with a hollow spigot 23 when being manufactured and the length of the spigot is longer than required to accept the length of a rivet 25. Plate 11 has an opening 26 which is of a diameter substantially the same as the external diameter of spigot 23. Opening 26 is counterbored at 27 on its outer end but can also be counterbored at the inner end to engage over a portion of large diameter at the base of spigot 23.

Plate 11 is placed in position by engaging spigot 23 in opening 26 and placing the end of the shank of rivet 25 in the spigot. Rivet 25 is then forced into the spigot until the curved underside of the head of the rivet engages the upper end of the spigot. As the rivet continues its inward passage the spigot end is forced over to flow into the area between the underside of the head and the counterbore 27. The tail 28 of rivet 25 is then crimped over to trap the rivet in place. As previously described there is no metal to metal contact between the rivet and plate except slight contact may occur at the sides of the head. This will, however, be of no consequence as some nylon or plastics material tends to flow up around the side of the head so separating the side from the wall of the counterbore 27. This pivot is particularly useful as normally a steel insert would be needed to relieve repeated tensile strain being applied to the nylon or plastics material.

When a sash of large dimensions or heavy weight is being hung it is often desirable to relieve a transverse force in the pivot set up by any tensile force in arm 13. Accordingly, a small annular ridge (not shown) is formed in the face of the carriage 16 and is concentric with the axis of pivot 15. This ridge engages in a curved groove in plate 11 which groove has the same radius as the ridge on carriage 16. Thus any transverse force occuring in pivot 15 is absorbed by the interaction of the ridge and groove.

Plate 11 can if required have a bend 30 in its length adjacent carriage 16 so that the portion of the plate which couples to the carriage is in a lower plane to the remainder of the length of the plate where it is coupled at joint 14 to arm 13.

The stays as illustrated in FIGS. 1 and 4 differ in the construction of carriage 16. Reference will therefore firstly be made to the embodiments shown in FIG. 1 to 3.

In this embodiment of the stay the abutment means are formed by the lower edge of an opening 19 and an upstand 31. The opening 19 is formed in flange 18 adjacent the upper end of plate 10. Lip 21 engages in a groove 22 in carriage 16 but is terminated just short of the lower end of opening 19. The thickness of lip 21 is far less than the width of groove 22. The face of carriage 16 which is opposite the inner surface of flange 18 has a pair of spaced apart curved surfaces 24 which slidingly engage along the said inner surface of flange 18. At the top right hand corner of plate 10 the upstand 31 is provided and this can be in the form of a plate portion at an incline to the length of main length 17 or can be of curved profile. Curved surfaces 24 plus surfaces 24' form the sliding surfaces on which carriage 16 slides along plate 10.

To close the stay plate 11 is moved into alignment with plate 10 and carriage 16 moves from the lower position to the illustrated upper position. As the carriage nears the top of plate 10 at first curved portion (which with second curved portion 32' forms the engagement means of this embodiment) 32 of carriage 16 comes into engagement with upstand 31 slightly before upper surface 24 comes into alignment with opening 19. Continued upward movement causes the carriage to be angularly displaced about a point in its length toward flange 18 as upper curved surface 24 moves into opening 19 (see FIG. 1) with the result that the head of the sash mounted by the stay pulls in at the completion of its closing movement. Accordingly, and unlike known sliding carriage stays, this movement of the carriage causes the top pivot point 15 to move over toward flange 18 whilst at the same time completing its upward movement. Accordingly, the head of sash first clears the seals or sealing surfaces of the frame before coming into final engagement with such seals or sealing surfaces. Carriage 16 is able to pivot as described due to the width of groove 22 being greater than the thickness of lip 21 (see FIGS. 1 and 2). When the stay is opened the second curved portion 32' formed by upper curved surface comes into engagement with the lower edge of opening 19 and this interengagement causes carriage 16 to be angularly displaced outwardly.

Normally, a plastics material or nylon carriage would be prone to damage when, for example, a curtain becomes jammed between the sash head and frame during closing. In such a circumstance force would be applied to the carriage which would either break or suffer damage such as deformation. This is not so liable to happen with a stay having two arms as the forces are absorbed as compressional forces in the lower arm which can bend to release the compression. With the present stay the same situation occurs as the carriage engages between flange 18 and upstand 31 so that the forces set up in the stay are transmitted as compressional forces in the arm 13. As arm 13 can bend no damage occurs to the carriage 16.

Referring now to FIGS. 4 to 8 the carriage guide means has an additional rib 21' which is positioned on main portion 17 and located directly below lip 21. Carriage 16 is shown in more particular detail in FIGS. 7 and 8. A landing 34 is formed along one side of the carriage which when viewed in plan is generally V shape. A first guide projection or pin 35 is located at the apex of landing 34 and projects from both faces thereof. A second guide projection or pin 36 spaced apart from pin 35 is located at one end of landing 34 but only projects from the lower face thereof. Pin 36, the portion of pin 35 which projects from the lower face, and surface 34' (FIG. 8) form the sliding surfaces on which carriage 16 slides along plate 10. A curved slot 37 extends across the other arm of landing 34. The thickness of landing 34 is slightly less than the distance between the edges of tip 21 and rib 21'.

The abutment means is in the form of a projection or pin 38 is mounted on plate 10 and is located as part of the guide means near the upper end thereof. Return 19, lip 21 and rib 21' are relieved to accommodate pin 38. An opening slot 39 is formed in rib 21' at a distance from pin 38.

Referring to FIG. 5 the stay is shown in the closed position with the guide pin 35 and the upper portion of landing 34 located within the semi-enclosed portion defined by flange 18, return 20, rib 21' and lip 21. In this position pin 38 is located at the inner end of slot 37 and guide pin 36 is located outside the semi-enclosed portion.

During initial opening carriage 16 does not slide but is angularly displaced as it pivots about guide pin 35 so that guide pin 36 moves through opening 39 and locates within the semi-enclosed portion whilst slot 37 moves away from pin 38 to be clear thereof. Additionally the main part of the upper portion of landing 34 clears the semi-enclosed portion. The carriage 16 thus takes up the position shown in dotted detail in FIG. 5.

Once this has been completed carriage 16 is free to slide along plate 10 and is guided in this movement by pins 35 and 36 located within the semi-enclosed portion. It will be appreciated that the overall dimensions of pin 35 are such that it can not pass through opening 39. The position of the carriage during the sliding movement is shown in FIG. 4 and it is clear that the sash S is held clear of frame F.

Figure 13:
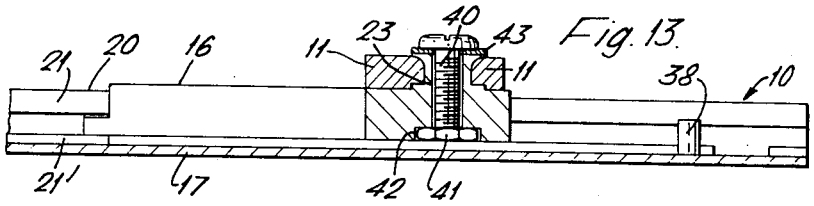

As the window is closed this sequence is reversed until in the final few degrees of closing the sash is angularly displaced and moves directly inwards. As with the first form of the stay previously described the carriage is angularly displaced so that as the top pivot 15 moves upwardly it also moves in toward flange 18. The degree of inward movement of pivot 15 during the closing operation is much greater than with the first form of stay and thus makes this form most suitable for an overlap sash. This inward movement of the sash thus allows direct compression of a soft seal behind the sash to provide for effective weather proofing on the now well known pressure equalisation principal.

Where necessary the level of friction can be regulated by incorporating an adjustment in joint 15. This can be provided as shown in FIG. 13, by rivet 25 being replaced by a screw 40 which extents through the spigot 23. Screw 40 engages in a nut 41 positioned in a recess 42 in the underside of carriage 16. As screw 40 is screwed downwardly into nut 41 the washer 43 under the screw head engages the extreme end of spigot 23 to deform it from the shape shown in FIG. 8 to that shown in FIG. 13. Accordingly, plate 11 is separated from screw 40 by the material of spigot 23 so that movements of plate 11 does not tend to tighten or loosen screw 40. Friction in the joint can be adjusted by screwing the screw in or out of nut 41 which respectively increases or decreases the pressure exterted on the spigot to increase or decrease friction in the joint.

Figure 15:
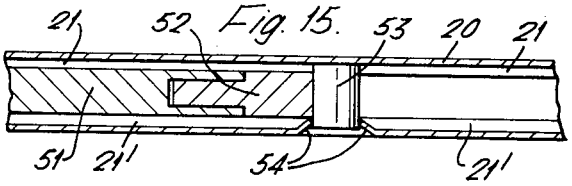
FIG. 15 is an enlarged sectional view on the line II—II of FIG. 14.
Figure 14:
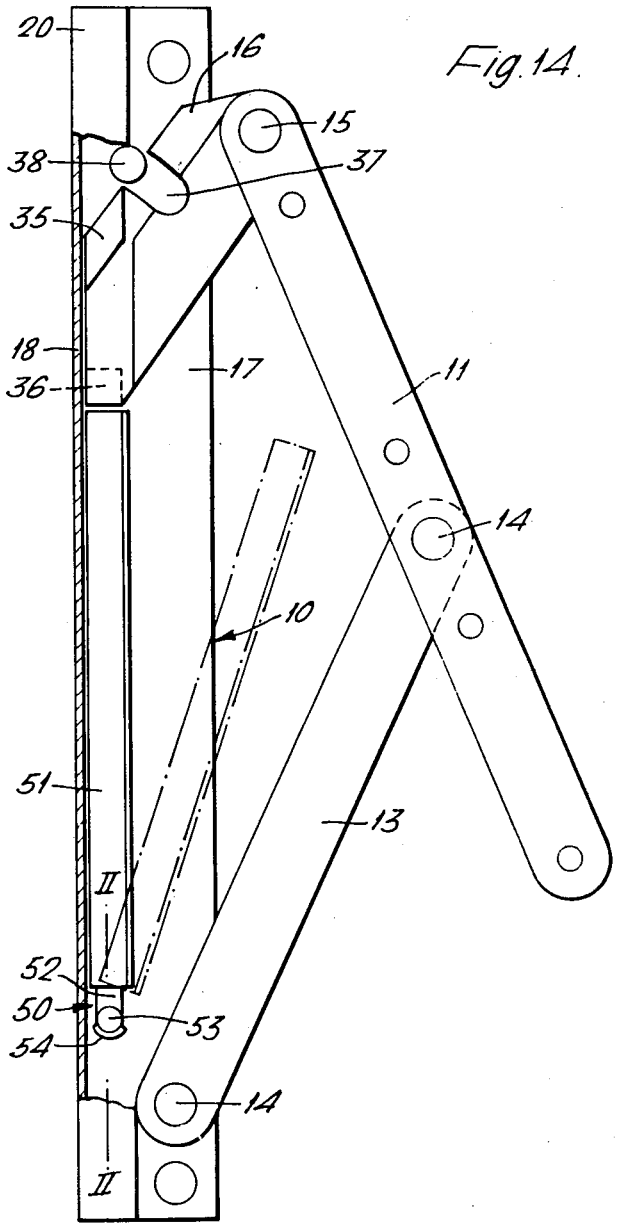
FIG. 14 is a side view of a modified form of the stay shown in FIG. 5.

Referring to FIGS. 14 and 15 a modified form of the stay as illustrated in FIGS. 4 and 5 is shown. With this form of stay normal ventilation through a window can be obtained by merely opening the stay until the carriage 16 is in the position shown in dotted detail in FIG. 5. Alternatively, some building codes may require that opening of a window is restricted for safety reasons. Accordingly, in the form shown in FIGS. 14 and 15 a restrictor is fitted.

This restrictor consists of a pivot 50 to which is coupled an arm 51. Pivot 50 is formed by a nylon material body 52 having a cylindrical portion 53 which is of a length approximately equal to the distance between return 19 and main portions 17. Assembly with plate 10 is extremely simple as cylindrical portion 53 is first placed between return 20 and main portion 17. A punch is then bought into contact with the undersided of main portion 17 and this punch is so constructed as the form two arcuate shear lines in plate 10 and then deforms the plate by pushing inwardly the area adjacent to the shear lines so as to form upstands 54. These upstands 54 capture cylindrical portion 53 in place. It will be appreciated that in this assembly procedure the cylindrical portion 53 forms the die part against which the punch operates.

Body 52 as mentioned is preferably of nylon construction with arm 51 either formed integrally therewith or being of metal construction and push fitted to the body. As shown arm 51 extends along plate 10 so that whilst carriage 16 can open to the dotted position shown it is prevented from sliding along plate 10. To facilitate sliding movement arm 51 is pivoted outwardly (cylinder 53 being rotatable within the confines of upstands 54) as shown in dotted detail. Arm 51 automatically resumes its normal position during closing of the stay due to movement toward plate 10 of arm 13 engaging with arm 51.

Whilst functioning as a restrictor, arm 51 also provides a dust cover to the semi-enclosed portion as it covers the opening between lip 21 and rib 21'. If required arm 51 can be uncoupled from body 52 whereupon the body forms a stop to limit carriage travel along plate 10.

A third form of the stay is shown in FIGS. 9 to 12 and in this form the carriage 16 is of the type illustrated in FIGS. 4 to 8 except it is a steel plate with nylon pads forming pins 35 and 36. The design of the stay however, differs in the attachment of arm 13 to plate 10.

Figure 9:
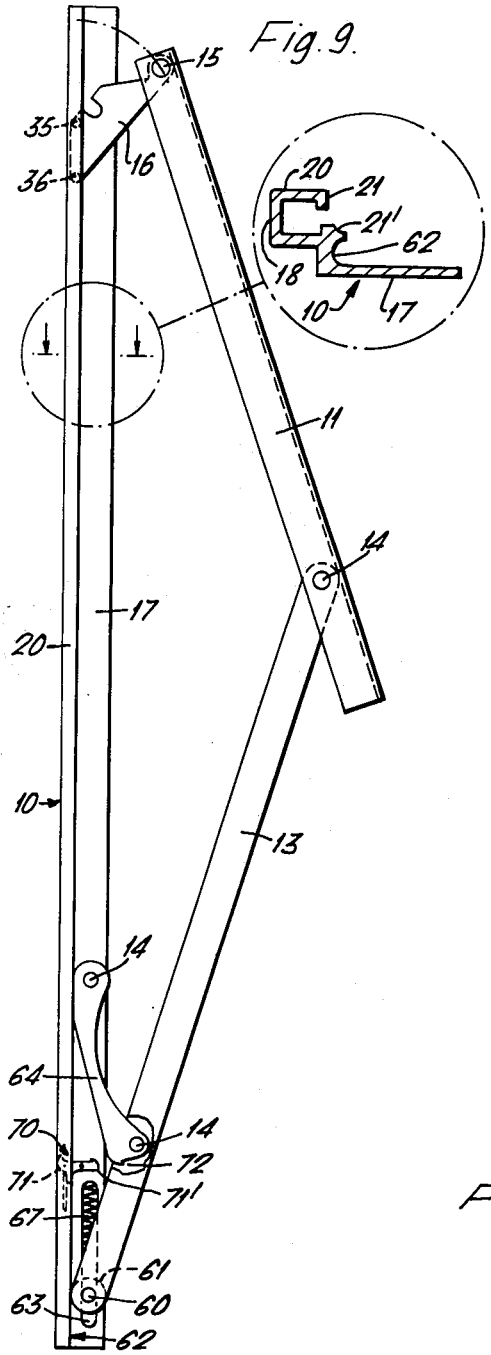
Figure 12:
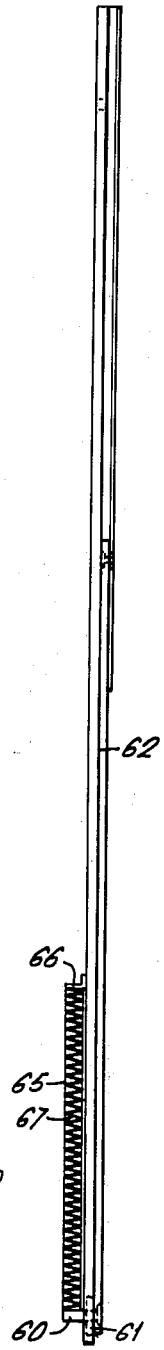
Figure 10:
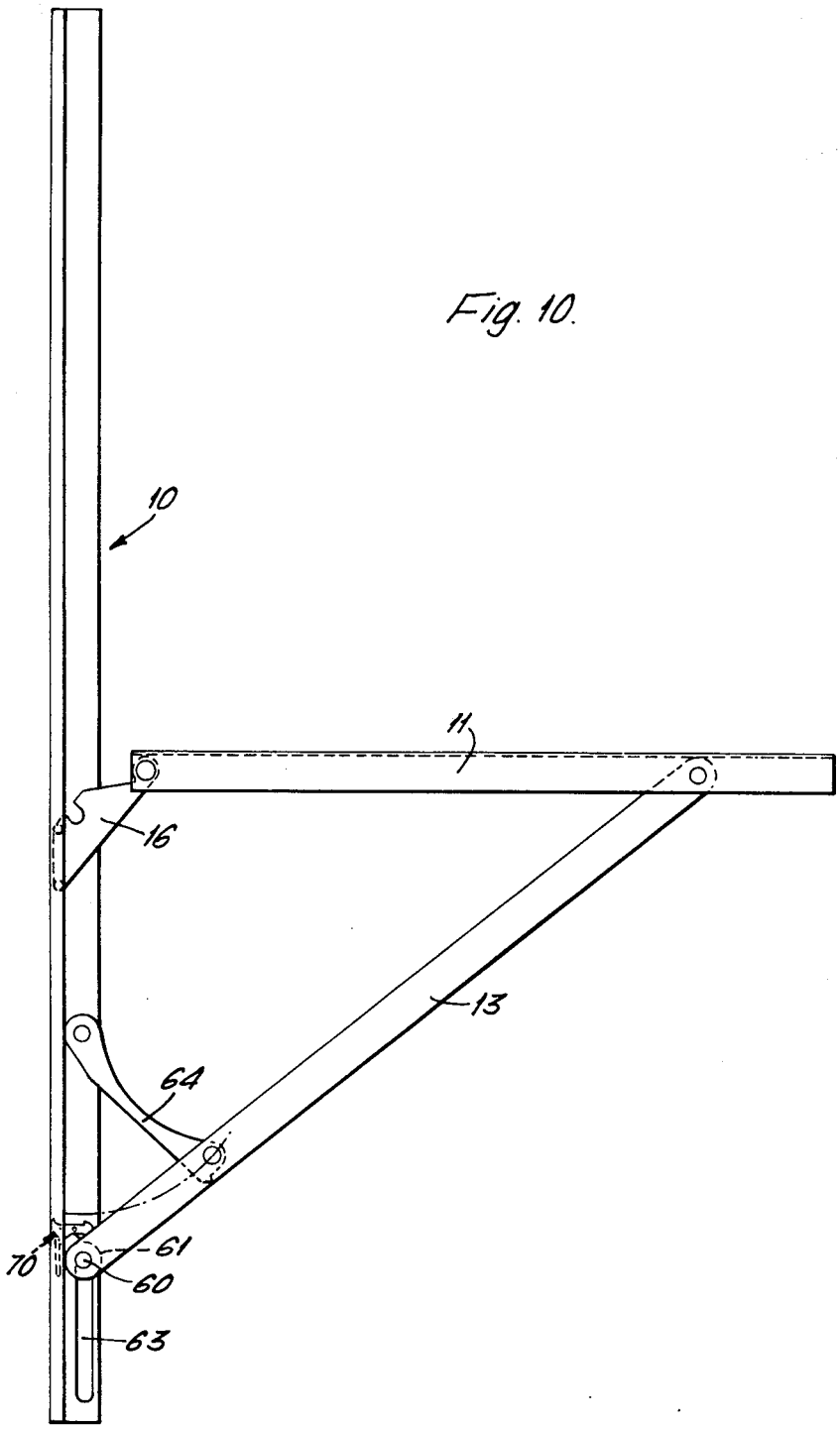

In this form arm 13 is provided at its lower end with an axle 60 on which is journalled a roller or wheel 61 engaging in a track 62 disposed between main portion 17 and rib 21'. Extending from adjacent the lower end of main portion 17 is a longitudinal slot 63 and through this extends the outer end of axle 60. The detail insert in FIG. 9 illustrates the cross-sectional shape of plate 10.

An arm 64 is pivotally coupled by one end to plate 10 upwardly of slot 63 and by its other end to arm 13. When the stay is in the closed position there is sufficient clearance between arm 13 and plate 10 to accommodate the thickness of arm 64.

The end of axle 60 which extends through slot 63 is journalled in a housing 65 which extends upwardly along plate 10. A spring 67 is located between axle 60 and end wall 66 of housing 65.

With the stay in the closed position i.e. with arm 13 and sash plate 11 substantially aligned along plate 10 axle 60 is at the lower extremity of slot 63. (see FIG. 12) As the stay is opened (see FIG. 9) the lower end of arm 13 commences an upward movement due to the pivoting of this arm being about its pivotable coupling to arm 64 which is itself pivotally coupled to plate 10. When the sash plate 11 is substantially normal to the plane of plate 10 (see FIG. 10) the lower end of arm 13 has reached its maximum upward movement such that axle 60 is situated at the upper extremity of slot 63. Accordingly, spring 67 is fully compressed.

Further opening i.e. reversal of sash plate 11 is accompanied with a downward movement of the lower end of arm 13 until axle 60 is once more positioned at the lower extremity of the slot 63 with spring 67 being in its relaxed state.

This form of the stay is designed for a large dimension sash where the weight of the sash, especially if double glazing is employed, is very high. The operation of the stay is such that the movement of pivot 14 of arm 13 to sash plate 11 away from plate 10 is on more of a level line than with the stay of the previously described forms. This means that during opening of the window the person opening the window does not have to support the weight of the sash as it is in effect pivoting about a pivot point maintained at a constant level in relation to the frame plate 10. During the opening to the position where the sash is normal to the frame spring 67 controls movement as the window would tend to drop rapidly if the spring were not present. After the horizontal position has been passed the compressed spring urges axle 60 downwardly thus assisting in the further reversal or opening of the sash. Accordingly, in this phase of opening spring 67 assists in the reversing operation.

With large dimension and heavy sashes it is normal to provide a safety latch so that the initial opening is restricted to a few degrees. To facilitate this a catch 70 is pivotally mounted to frame mounting plate 10. This catch 70 has a hancle end 71 and latch end 71, the latter engaging with rebate 72 on the lower end of arm. Catch 70 is spring biassed so that upon closing of the stay rebate 72 rides over the curved latch end 71 to automatically be engaged with the catch preparatory to the stay being opened again.

Figure 11:
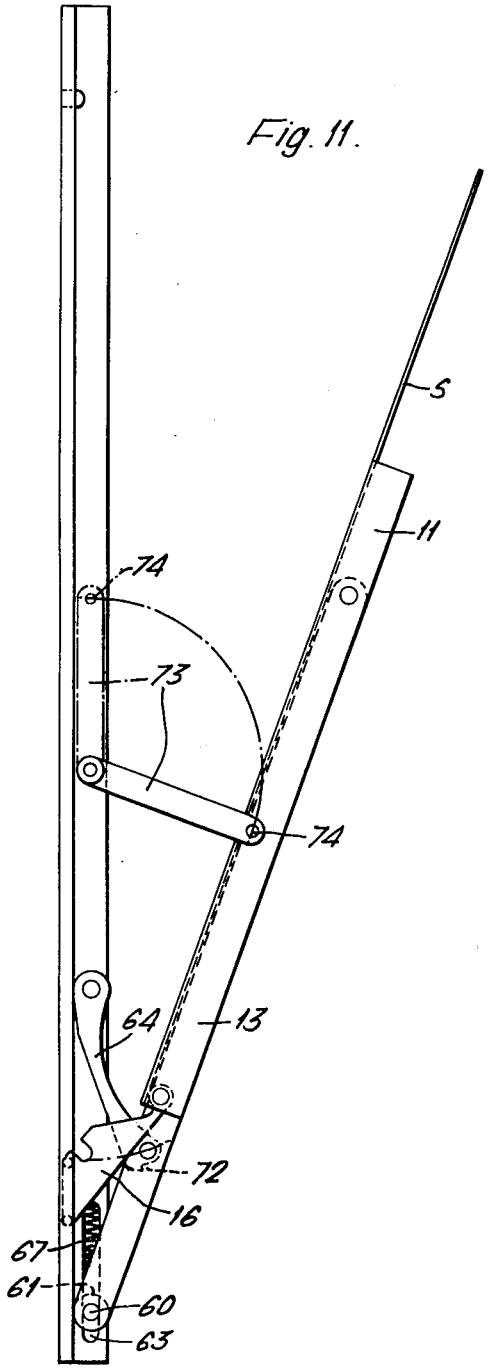

When the sash is reversed as shown in FIG. 11 it is necessary to support the sash to prevent accidental movement thereof. An arm 73 pivotally coupled to plate 10 is thus provided. This arm 73 has a projection 74 on its free end and this can be engaged with the side flange of sash S. When not required in use arm 73 lies parallel to plate 10 as illustrated in FIG. 11.

In all other respects the stay as shown in FIGS. 9 to 12 operates on the basis of the stay as shown in FIGS. 4 and 5 with the carriage being angularly displaced inwardly at the final closing stages to provide the necessary pull-in.

Figure 16:
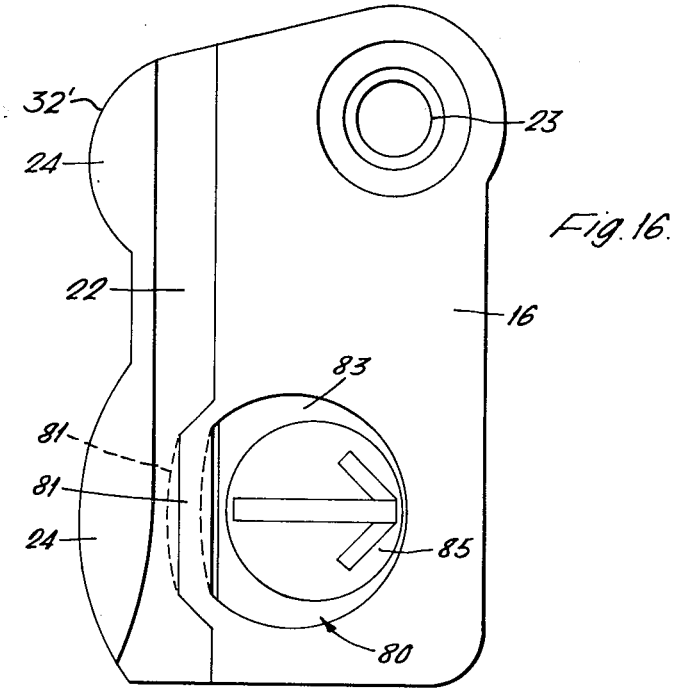
FIG. 16 is an enlarged plan view of a modified form of the carriage shown in FIGS. 1 to 3 and FIG. 17 is a cross-sectional view on line III—III of FIG. 16.
Figure 17:
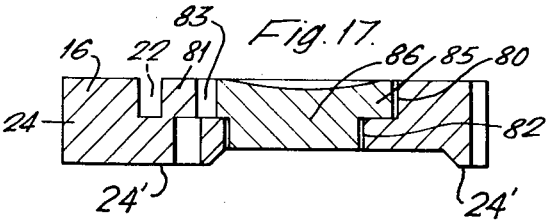

In the described and illustrated forms of the stay the carriage is free sliding and the friction is derived from pivots 14 and 15. Accordingly, to alternative forms the friction could be derived from the carriage movement with pivots 14 and 15 not being of a friction type or else friction of the carriage could be increased to be additional to that of pivots 14 and 15. By way of example a carriage with an adjustment to increase resistance to movement is shown in FIGS. 16 and 17. This adjustment may be required with an heavy sash or in areas in which high winds prevail.

Carriage 16 includes a recess 80 located adjacent groove 22 and a thin wall section 81 separates the groove from the recess. This wall 81 forms a straight side to recess 80 whilst the remainder is circular. An opening 82 is formed in the bottom surface 83 of recess 80 and is coaxial with the curved wall of the recess. An operating cam member is composed of two circular portions 85 and 86 with one affect to the other. Portion 86 engages in opening 82 whilst portion 85 engages in recess 80. As the cam is rotated from the position shown the edge of portion 85 comes into engagement with wall 81 to cause it to bow (as indicated in dotted detail) so that the wall and other side of groove 22 come into engagement with lip 21 thus setting up a frictional resistance to movement. As wall 81 is located in the region of lower curved surface 24 the engagement with lip 21 of the groove and wall surfaces does not prevent the angular displacement of carriage 16.

With stays of the present invention positioned in the window frame and a window sash attached thereto the window can be operated effortlessly to all angles of opening even beyond 90° whilst the friction pivots 14 and 15 provide the correct amount of friction for control at all angles of opening. Friction is important during the initial opening stages of the stay and in the form of the invention shown in FIGS. 4 and 5 relative movement between the carriage 16 as it is angularly displaced in relation to plates 10 and plate 11 as it is angularly displaced relative to the carriage 16 ensure a high degree of friction which ensures complete control of the sash opening or closing. The sash is also ensured of being maintained at the selected open position. As the carriage slides on the plate 10 in a male/female type configuration the carriage is not prone to becoming jammed especially as it is designed to operate with minimum friction. Accordingly, the problems associated with known sliding shoe stays are not experienced with stays according to present invention. This stay thus overcomes problems associated with known stays as the means for setting out friction to maintain the window sash in an open position is completely divorced from the means providing the sliding action of the head of the sash plate along the frame plate.

Whilst the stay has been described as being fitted to the vertical sides of the sash frame it will be appreciated that it can be equally used in a casement application. In a casement hung window a wide angle of opening is provided thus allowing a high degree of ventilation as is required in some countries. In addition the stay is of a compact dimension so that it can fit into a cavity in a sash S even when the front to back dimensions of the cavity are necessarily small. This can arise due to thin sashs being used in certain applications or with certain types of known frames.

I claim:

1. A window stay for adjustable mounting of a window sash into a window frame comprising a first mounting plate adapted for attachment to the frame of a window, a second mounting plate adapted for attachment to a sash of a window, a carriage slidably mounted on the first mounting plate, characterized in that an arm is pivoted at one end to the second mounting plate and at its other end to the first mounting plate, the second mounting plate being further pivoted, at a point remote from the pivot coupling the arm, to the carriage, abutment means provided with said first mounting plate and engagement means provided with said carriage and which cooperate with said abutment means during the initial opening and final closing operations of the stay to cause displacement of the carriage such that the pivot coupling the arm to the carriage is angularly displaced across the face of the first mounting plate.

2. A window stay as claimed in claim 1 wherein said engagement means is a curved surface portion of said carriage.

3. A window stay as claimed in claim 2 wherein said carriage includes sliding surfaces at least part of which engage with guide means on said frame mounting plate.

4. A window stay as claimed in claim 3 wherein said abutment means is formed by a projection with said guide means, said curved surface being formed by a slot in the carriage, said slot being curved and of a width sufficient to accommodate said projection.

5. A window stay as claimed in claim 4 wherein the sliding surfaces of said carriage includes a pair of spaced apart guide projections; said guide means includes a pair of spaced apart longitudinally disposed members between which a portion of said carriage projects, one of said guide projections being disposed to one side of said longitudinal members whilst the pivot connection of said sash mounting plate is disposed to the other side, the second guide projection being movable from one side to the other of said longitudinal members in response to the displacement of said carriage so that during sliding movement of the carriage said guide projections are disposed to the same side of said longitudinal members.

6. A window stay as claimed in claim 5 wherein a gap is provided in at least one longitudinal member to allow passage therethrough of said second guide projection.

7. A window stay as claimed in claim 3 wherein said abutment means is formed by a projection mounted with said frame mounting plate and substantially transversely disposed therefrom the edge of an opening formed with said guide means, the curved surface portion of said carriage being a first curved surface adjacent the pivot coupling of said sash mounting plate to said carriage and spaced substantially therefrom a curved guide projection engageable in said guide means opening.

8. A window stay as claimed in claim 7 wherein said carriage includes a second guide projection spaced apart from said first curved guide projection; said guide means includes a pair of longitudinally disposed members which are spaced apart transversely of the frame mounting plate, a first of said guide members engaged in a groove in said carriage whilst the said guide projection engage with the second of said guide members.

9. A window stay as claimed in claim 1 wherein said carriage is of nylon or other plastics material construction, said carriage having a integrally formed spigot with a through bore, said spigot being inserted in an opening in said sash mounting plate, a headed fastening being inserted into said through bore with the end thereof remote from said head being coupled to the carriage at the side opposite to that from which said spigot projects, the head of said fastening deforming said spigot thereby retaining said sash plate on said spigot but preventing contact of said fastening with said sash plate.

10. A window stay as claimed in claim 9 wherein said fastening is a rivet.

11. A window stay as claimed in claim 9 wherein said fastening is a bolt which engages in a nut captured in a recess in said carriage.

12. A window stay as claimed in claim 4 wherein said arm is pivotally coupled to said frame mounting plate by a secondary arm which is pivotally coupled to said frame mounting plate and said arm inwardly of their respective ends.

13. A window stay as claimed in claim 12 wherein the end of said arm beyond the pivot of said secondary arm has a wheel or roller mounted thereon, said wheel or roller engaging in a track on said frame mounting plate.

14. A window stay as claimed in claim 13 wherein said arm end has a projection located in a longitudinal slot in said frame mounting plate, their being spring means engaged with said projection to bias said projection toward the end of the slot furthest from the pivot coupling said secondary arm to the frame mounting plate.

15. A window stay as claimed in claim 3 further including a member for restricting sliding movement of said carriage along said frame mounting plate, said restrictor comprising a mounting having a cylindrical portion rotatably engaged between a pair of carved projections pressed from the parent material of said frame mounting plate, an arm extending from said mounting along said guide means.

16. A window stay as claimed in claim 1 wherein the carriage is free sliding and at least one of said pivots between said arm and the frame and sash mounting plates is a wear-resistant friction pivot.

17. A window stay as claimed in claim 16 wherein said wear-resistant friction pivot is formed by a rivet passing through openings in the arm and respective frame and sash mounting plates, the tail of the rivet being fixedly engaged with the plate, the shank and head of the rivet being separated from said plate and arm by a wear resistant plastics material.

18. A window stay as claimed in claim 17 wherein the head and tail of said rivet are located in recesses in the respective arm and plate, the opening in said plate in which a tail end of said rivet is engaged being non-circular and the tail of the rivet being crimped over into the said recess.

* * * * *